United States Patent [19]

Chelin

[11] 4,252,216

[45] Feb. 24, 1981

[54] HEAVY DUTY CARRIAGE GUIDES

[75] Inventor: Charles R. Chelin, Peoria, Ill.

[73] Assignee: Towmotor Corporation, Mentor, Ohio

[21] Appl. No.: 766,103

[22] Filed: Feb. 7, 1977

[51] Int. Cl.[3] ..... B66B 9/20; B66B 7/02

[52] U.S. Cl. ..... 187/9 E; 187/9 R; 187/95

[58] Field of Search ..... 187/9 R, 9 E, 95

[56] References Cited

U.S. PATENT DOCUMENTS

| | | | |
|---|---|---|---|
| 1,483,600 | 2/1924 | Schroeder | 187/9 R |
| 1,954,345 | 4/1934 | Burrows | 187/9 R |
| 2,787,337 | 4/1957 | Quayle | 187/9 E |
| 3,018,849 | 1/1962 | Kush | 187/9 E |
| 3,032,377 | 5/1962 | Blase | 187/95 |
| 3,035,663 | 5/1962 | Mehlmann | 187/9 E |
| 3,044,576 | 7/1962 | Quayle | 187/9 E |
| 3,178,048 | 4/1965 | Bergman et al. | 187/9 R |
| 3,235,034 | 2/1966 | Quayle | 187/9 E |
| 3,563,341 | 2/1971 | Bultman | 187/95 |

*Primary Examiner*—Jeffrey V. Nase
*Attorney, Agent, or Firm*—Phillips, Moore, Weissenberger, Lempio & Majestic

[57] ABSTRACT

The invention is concerned with an improved carriage guide and mast stiffener for a lift mast of the sort used on a lift truck or the like. Such a lift mast comprises a pair of spaced apart outer mast members, a pair of spaced apart inner mast members between the outer mast members, each slidably mounted in a respective one of the outer mast members and a carriage structure mounted on the inner mast members for translation therein. The improved structure of the present invention comprises a pair of rails each affixed to extend longitudinally along a respective outer surface of a respective one of the outer mast members and a pair of bearings affixed to the carriage structure, each snugly but slidably engaging a respective one of the rails and allowing relative longitudinal translation of the carriage structure relative to the outer mast members while preventing other translation therebetween.

22 Claims, 4 Drawing Figures

HEAVY DUTY CARRIAGE GUIDES

BACKGROUND OF THE INVENTION

1. Field of the Invention

The invention is concerned with an improvement in the art of translating a carriage relative to outer and inner mast members. Most particularly the invention is concerned with an improvement in a mast assembly as is used on a lift truck.

2. Prior Art

Mast assemblies are well known which include a pair of spaced apart outer mast members, a pair of spaced apart inner mast members between the outer mast members, each of the inner mast members being slidably mounted in a respective one of the outer mast members and a carriage or the like which is mounted on the inner mast members for translation therein. A great number of common lift trucks have such a structure. For example, U.S. Pat. DES. No. 235,056 clearly illustrates a lift truck having such a mast assembly.

A serious problem, has existed with prior art mast assemblies of the type just described. In particular, the strength and stability of such a mast assembly has at times been insufficient for heavy duty applications such as arise in forest logging operations due to the relatively very large moments of force which are exerted upon one or more members thereof, for example upon the carriage thereof. A typical carriage has side thrust rollers which are adequate for light duty applications, however for use in heavy duty applications such as forestry logging operations these are not fully adequate. Further, the spaced apart outer mast members which are generally supporters of the rest of the structure have a tendency to spread apart due to side thrust load causing excessive wear and ultimate premature failure of loaded components. Also, when loads are suddenly taken up, for example on the carriage of such a heavy duty mast assembly, the mast and carriage of the assembly would normally be dragged against one another under relatively high stresses. Very importantly in heavy duty applications undesirable excessive loading of the carriage rollers occurs during impact loading along with cocking of the carriage due to unbalance of the load on the forks of the carriage.

SUMMARY OF THE INVENTION

The present invention is directed to overcoming one or more of the problems as set forth above.

According to the present invention an improved carriage guide and mast stiffener is provided which is useful in a lift mast assembly comprising a pair of spaced apart outer mast members, a pair of spaced apart inner mast members between the outer mast members each slidably mounted in a respective one of the outer mast members and carriage means mounted on the inner mast members for translation therein. The improved carriage guide and mast stiffener comprises a pair of rails each affixed to extend longitudinally along a respective outer surface of a respective one of the outer mast members and a pair of bearing means affixed to the carriage means, each snugly but slidably engaging a respective one of the rails and allowing relative longitudinal translation of the carriage means relative to the outer mast members while preventing cocking of the carriage.

Through use of the improved carriage guide and mast stiffener of the present invention, solutions to all of the above set out problems of the prior art are attained.

BRIEF DESCRIPTION OF THE DRAWING

The invention will be better understood by reference to the figures of the drawing wherein like numbers denote like parts throughout and wherein.

DETAILED DESCRIPTION OF THE PREFERRED EMBODIMENT

Figure 1:
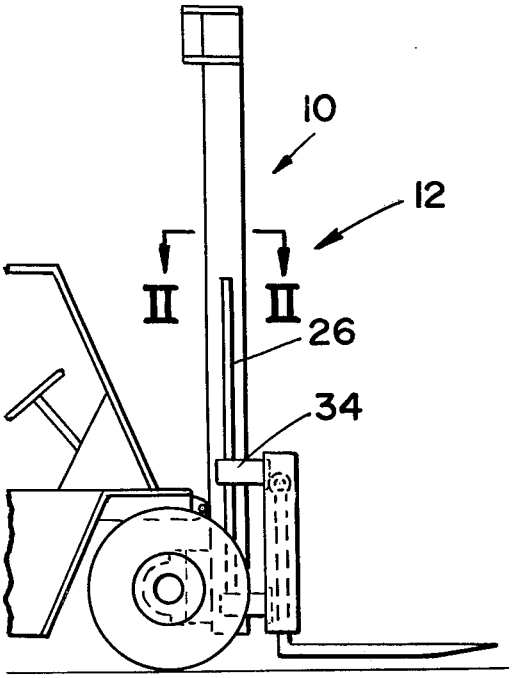
FIG. 1 illustrates in side view a lift truck having a lift mast assembly improved in accordance with the present invention.

The following description relates to an assembly which includes both stationary outer masts with a carriage slidably held by the inner masts but it will be understood that the principle of the invention are equally applicable to units which only contain a stationary outer mast with the carriage slidably held thereby, to triple mast units, and the like.

Adverting particularly to the figures of the drawing, there is illustrated therein a lift mast assembly 10 of a lift truck 12 with the lift mast assembly 10 including a pair of spaced apart outer mast members 14 each of generally U-shaped configuration (but which could equally well be of I-shape or J-shape configuration), a pair of spaced apart inner mast members 16 between the outer mast members 14, each of the inner mast members 16 being slidably mounted as by rollers 18 in a respective one of the outer mast members 14 and carriage means, in the embodiment illustrated a carriage 20 mounted on the inner mast members 16 for translation therein as by movably fitting therein via respective rollers 22. Movement of the inner mast members 16 relative to the outer mast members 14 and of the carriage 20 relative to the inner mast members 16 is motivated by a conventional hydraulic motor 24 or the like. All of the above described structures are conventional in the art.

Turning now to the improvement of the present invention, this comprises first a pair of rails 26 each affixed to extend longitudinally along a respective outer surface 27 of a respective one of the outer mast members 14. Also part of the improvement of the present invention are a pair of bearing means 28 affixed to the carriage 20 with each of the bearing means 28 snugly but slidably engaging a respective one of the rails 26 and allowing relative longitudinal translation of the carriage means 20 relative to the outer mast members 14 while preventing side tipping or cocking of the carriage under a typical load cycle as found in the tree harvesting industry.

Figure 3:
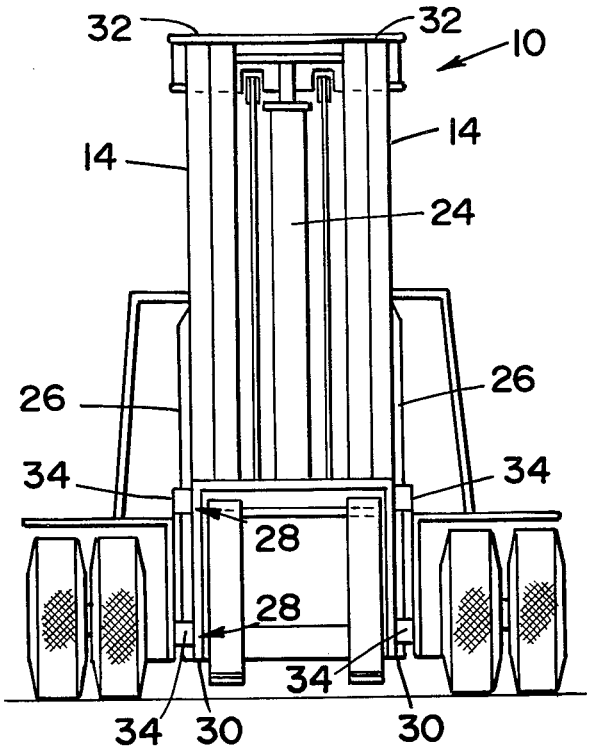
FIG. 3 illustrates, in front view, a lift truck as in FIG. 1.

As will be noted most particularly by reference to FIGS. 1 and 3, each of the rails 26 extend from adjacent a bottom 30 of each of the outer mast members 14 to a spaced distance removed from a top 32 thereof. The rails 26 do not generally extend the length of the outer mast members 14 since their use is primarily for support of the carriage means 20 during travel and loading. As will be noted most clearly from FIG. 2, each of the rails 26 is generally rectangular in cross-section for proper engagement with the bearing means 28.

Figure 2:
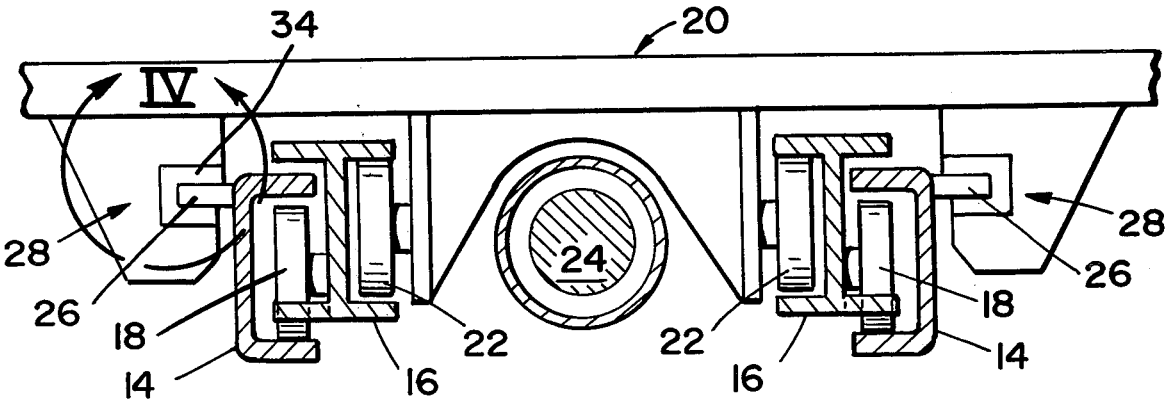
FIG. 2 illustrates a view taken along the line II—II of FIG. 1.
Figure 4:
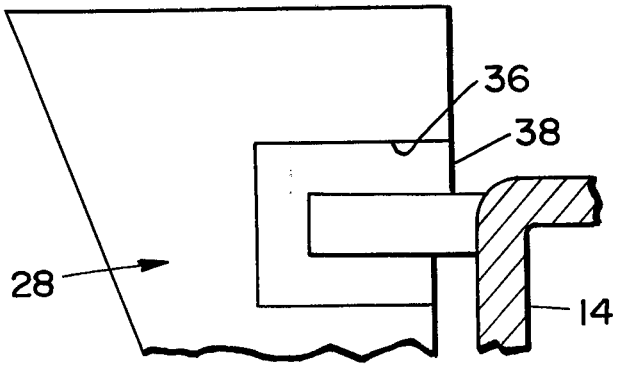
FIG. 4 illustrates, in enlarged view, the area IV of FIG. 2.

Turning now most particularly to the bearing means 28, it will be seen most clearly from reference to FIGS. 2 and 4 that each of the bearing means 28 preferably comprise a pair of rail mating bearings 34 spaced longitudinally apart from one another along the carriage 20. Further, each of the bearing means 28 preferably comprises a U-shaped notch 36 for engagement with a respective one of the rails 26. As will also be noted most particularly by reference to FIG. 4, each of the bearing means 28 includes a bearing material 38 in each of the respective nitches 36. The bearing material 38 must be quite tough in order to withstand the hard usage to which it is exposed in lift truck assemblies. For example, the bearing material can be bronze or brass. Alternatively, certain ultra high molecular weight polyolefin polymers can desirably be used as the bearing material 38.

A low friction and relatively high molecular weight polyolefin polymer may be used as the material from which the bearing material 38 is formulated since its abrasion resistance is greatly increased at the higher molecular weights. Preferably the bearing material is selected from the ultra high molecular weight (UHMW) polyolefin polymer material group consisting of polyethylene, polypropylene and co-polymers thereof. In carrying out the present invention such polymers should have a molecular weight of at least about 1.7 million in order to obtain sufficient wear resistance for the rough usage contemplated. More preferably, such polymers will have a molecular weight of more than about 3.0 million. The polymers can also advantageously contain various fillers, e.g., glass beads, glass fibers, graphite and the like to improve stiffness, cold flow and heat deflection. A particularly useful non-halogenated polymer having the aforementioned physical characteristics comprises an ultra high molecular weight polyethylene having a molecular weight of at least approximately 3.5 million. Such polymers are commercially available, for example, from such suppliers as Hercules, Inc., and American Hoechst Corp. A very complete description of such materials can be found in Materials Engineering, the issue of September 1971, at pages 34–39.

Pursuant to the present invention, the increased abrasion resistance and relatively low coefficient of friction due to the relatively high molecular weight of the replaceable polyolefin polymer bearing material markedly improves the service life thereof. This is in marked contrast to conventional polytetrafluoroethylene coatings which have molecular weights in the range of approximately 20,000 and which wear so significantly that they are generally considered impractical. Further, the ultra high molecular weight bearing is sufficiently elastic that it exhibits superior impact resistance and elastic recovery, or an ability to return to its original state after being highly locally deformed.

It will be noted that as the respective bearing means 28 move slidably within the respective rails 26 the carriage 20 will be held to move in longitudinal translation relative to the outer masts 14 and the masts 16. At the same time, the carriage 20 acting via the bearing material 38 and the U-shaped notches 36 will force the outer mast members 14 to stay together. This in turn will properly constrain the inner mast member 16. What results is an engagement between the carriage 20 and mast members 14 and 16 which assures that relative longitudinal translation therebetween can occur with a minimum of frictionally wasted energy while other translation therebetween, most particularly carriage cocking, is prevented and the masts are stiffened sufficiently for heavy duty operation in the manner just described.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a lift mast assembly comprising at least a pair of spaced apart mast members, each mast member comprising an inner mast member and an outer mast member, wherein the inner mast member is slidably mounted in the outer mast member, and carriage means mounted in said inner mast members for translation therein, an improved carriage guide and mast stiffener, comprising:

a pair of rails each affixed to and extending longitudinally along a respective outer surface of a respective one of the outer mast members; and a pair of bearing means affixed to said carriage means each snugly but slidably engaging a respective one of said rails and allowing relative longitudinal translation of said carriage means relative to said outer mast members while preventing other translation therebetween.

2. An improved carriage guide and mast stiffener as in claim 1, wherein said rails extend from adjacent a bottom of each of said outer mast members to a spaced distance removed from a top thereof.

3. An improved carriage guide and mast stiffener as in claim 1, wherein each of said bearing means comprise a pair of rail mating bearings spaced longitudinally apart from one another along said carriage means.

4. An improved carriage guide and mast stiffener as in claim 1, wherein each of said rails has a rectangular cross-section and said bearing means comprises a U-shaped notch for engaging with a respective one of said rails.

5. An improved carriage guide and mast stiffener as in claim 4, wherein each of said bearing means comprise a pair of said U-shaped notches spaced longitudinally apart from one another along said carriage means.

6. An improved carriage guide and mast stiffener as in claim 5, wherein said rail extend from adjacent a bottom of each of said outer mast members to a spaced distance removed from a top thereof.

7. An improved carriage guide and mast stiffener as in claim 5, including a bearing material surface on each of said notches.

8. An improved carriage guide and mast stiffener as in claim 7, wherein said bearing material comprises bronze.

9. An improved carriage guide and mast stiffener as in claim 7, wherein said bearing material comprises brass.

10. An improved carriage guide and mast stiffener as in claim 7, wherein said bearing material comprises an ultra high molecular weight polyolefin polymer.

11. An improved carriage guide and mast stiffener as in claim 1, wherein said lift mast assembly is mounted to a lift truck.

12. In a lift truck mast assembly comprising a pair of spaced apart stationary mast members and carriage means having a pair of spaced apart rollers engageable with a respective inner surface of a respective one of said stationary mast members, said carriage means mounted on said stationary mast members via said pair of spaced apart rollers for translation relative thereto, an improved carriage guide and mast stiffener, comprising:

a pair of rails each affixed to and extending longitudinally along a respective outer surface of a respective one of said mast members; and a pair of bearing means affixed to said carriage means each snugly but slidably engaging a respective one of said rails and allowing relative longitudinal translation of said carriage means relative to said mast members while preventing other translation therebetween.

13. An improved carriage guide and mast stiffener as in claim 12, wherein said rails extend from adjacent a bottom of each of said mast members to a spaced distance removed from a top thereof.

14. An improved carriage guide and mast stiffener as in claim 12, wherein each of said bearing means comprise a pair of rail mating bearings spaced longitudinally apart from one another along said carriage means.

15. An improved carriage guide and mast stiffener as in claim 12, wherein each of said rails has a rectangular cross-section and said bearing means comprises a U-shaped notch for engaging with a respective one of said rails.

16. An improved carriage guide and mast stiffener as in claim 15, wherein each of said bearing means comprise a pair of said U-shaped notches spaced longitudinally apart from one another along said carriage means.

17. An improved carriage guide and mast stiffener as in claim 16, wherein said rail extend from adjacent a bottom of each of said mast members to a spaced distance removed from a top thereof.

18. An improved carriage guide and mast stiffener as in claim 16, including a bearing material surface on each of said notches.

19. An improved carriage guide and mast stiffener as in claim 18, wherein said bearing material comprises bronze.

20. An improved carriage guide and mast stiffener as in claim 18, wherein said bearing material comprises brass.

21. An improved carriage guide and mast stiffener as in claim 18, wherein said bearing material comprises an ultra high molecular weight polyolefin polymer.

22. An improved carriage guide and mast stiffener as in claim 12, wherein said lift mast assembly is mounted to a lift truck.

* * * * *